United States Patent [19]

Zicko

[11] 4,186,866

[45] Feb. 5, 1980

[54] DISPENSER CONTAINER WITH COVER

[75] Inventor: James A. Zicko, Natick, Mass.

[73] Assignee: Container Corporation of America, Chicago, Ill.

[21] Appl. No.: 6,560

[22] Filed: Jan. 25, 1979

[51] Int. Cl.[2] ..... B65D 5/72

[52] U.S. Cl. ..... 229/17 B

[58] Field of Search ..... 229/17 B

[56] References Cited

U.S. PATENT DOCUMENTS

| | | | |
|---|---|---|---|
| 2,770,408 | 11/1956 | Lindeberg | 229/17 B |
| 3,002,651 | 10/1961 | Gauld | 229/17 B X |
| 3,193,152 | 7/1965 | White, Jr. | 229/17 B X |
| 3,207,380 | 9/1965 | Hennessey | 229/17 B X |
| 3,593,908 | 7/1971 | Desmond | 229/17 B |
| 3,944,128 | 3/1976 | Hogan | 229/17 B |

*Primary Examiner*—Davis T. Moorhead

[57] ABSTRACT

A dispenser container formed from a cut and scored blank of paperboard consists of a tube having a lower closure flap foldably connected to a back wall of the tube and a dispenser bin. The dispenser bin is formed in the lower area of the tube and has a cover which can be raised to disclose the contents of the bin.

1 Claim, 3 Drawing Figures

DISPENSER CONTAINER WITH COVER

SUMMARY OF THE INVENTION

The structure described and claimed herein is particularly adapted for the dispensing of articles by movement of a dispenser bin to and from dispensing position and to cover articles within the dispenser bin when it is not being used. The structure is formed from a single cut and scored blank folded to enclose articles for shipment and is readily adaptable for dispensing.

THE DRAWING

Figure 2:
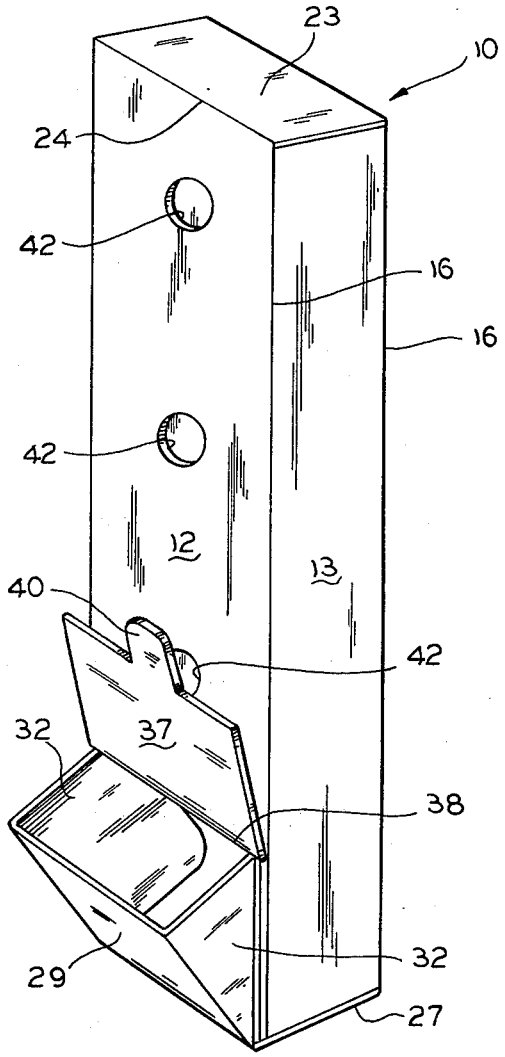
FIG. 2 is a similar view showing the container in the dispensing attitude.
Figure 1:
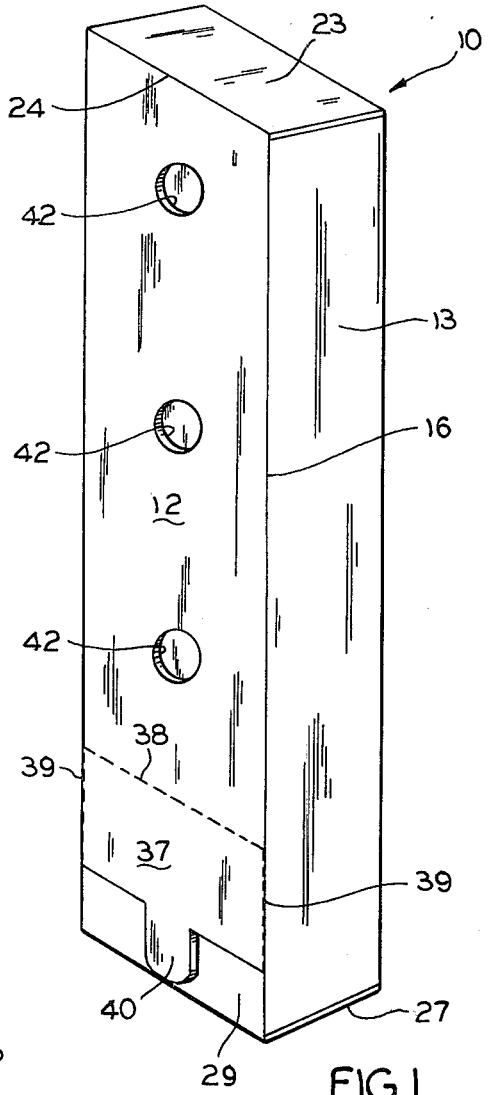
FIG. 1 is an isometric view of a dispenser container according to the present invention.
Figure 3:
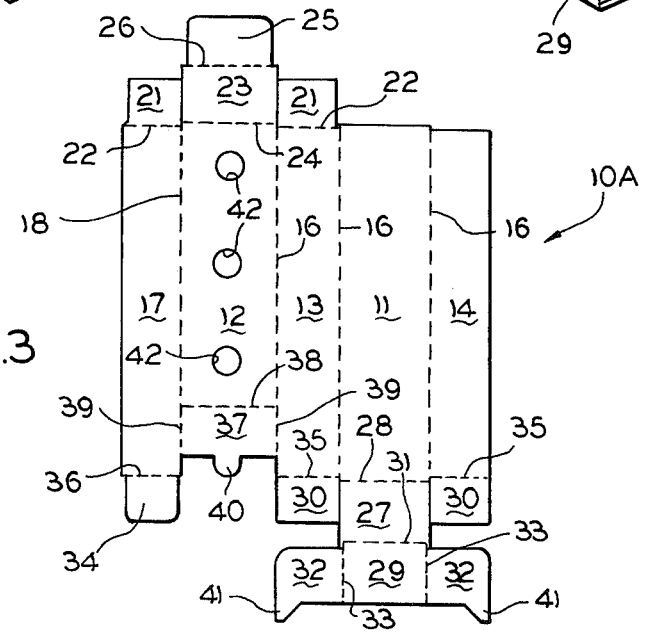
FIG. 3 is a plan view of a cut and scored blank of paperboard or the like for forming the container of the present invention.

The dispenser container according to the present invention is denoted generally by the reference numeral 10 and is formed from a cut and scored blank 10A of paperboard or the like.

The blank 10A consists of a rear wall 11, a front wall 12 and opposed side walls 13 and 14 foldably interconnected along fold lines 16. A manufacturer's glue flap 17 is foldably joined to front wall 12 along a fold line 18. In forming a tubular carton, the glue flap 17 is joined to a marginal edge of the side wall 14 to provide a container tube.

One end of the tube thus formed is closed by closure elements which include flaps 21 foldable with respect to the glue flap 17 and the side wall 13 along fold lines 22, an outer closure flap 23 foldable with respect to front wall 12 along a fold line 24, a tuck flap 25 foldable with respect to the outer closure flap 23 along a fold line 26. The flap 25 is folded into the tube to close one end thereof.

The opposite end of the tube is closed by an outer closure flap 27, foldable with respect to the rear wall 11 along a fold line 28, and by closure flaps 30 extending from the side walls 13 and 14 and foldable with respect thereto along fold lines 35. The glue flap 17 has a flap 34 foldable with respect thereto along a fold line 36 and into contact with the flap 30 extending from the side wall 14.

A dispenser bin structure is formed from a bin front element, or panel 29, foldable with respect to the closure flap 27 along a fold line 31, and is provided with bin forming side flaps 32 foldable with respect to the bin front panel 29 along fold lines 33.

Upon closing of this end of the tube, the front element 29 of the bin is brought beneath the front wall 12 of the tube with the bin forming the side flaps 32 attending along the inner faces of the side walls 13 and 14.

The bin front panel 29 is substantially covered by a dispenser bin cover 37 defined by a transverse fold line 38 in the front wall 12 and by opposed broken score lines 39 which are continuations of the fold line 18 and the fold line 16, respectively.

In order to adapt the bin structure for dispensing, the bin cover 37 is raised by lifting a tab 40 to break the score lines 39. The front panel 29 of the bin is then rocked about its fold line 31 together with the bin forming side flaps 32. The rocking movement is limited by stops 41 extending from the flaps 32 and being movable with the flaps 32 into an engagement with the back face of the front wall 12 of the tube at the fold line 38.

The open bin is closed by the bin cover 37 which can rest over the bin opening.

The container may be provided with apertures 42, or the like, in the front wall 12 for viewing the contents.

I claim:

1. A dispenser container formed from a cut and scored blank of paperboard or the like, comprising:

(a) front, rear and side walls hingedly interconnected along parallel fold lines and defining a tube;

(b) flap elements forming a closure for one end of said tube;

(c) a dispenser bin structure at the other end of said tube comprising an outer closure flap foldably connected to said rear wall, a dispenser bin front panel foldably connected to said closure flap, bin forming side flaps foldably connected to said bin front panel and foldable into position along the inner faces of said side walls of said tube;

(d) a dispenser bin cover formed in said front wall of said tube adapted to overlie said bin front element in the closed position of the latter;

(e) said bin cover being defined by a transverse score line in said front wall of said tube with the side edges of said cover being formed by broken score lines which are a continuation of the fold lines connecting said front wall and said side walls;

(f) said bin cover being foldable relative to said front bin element by fracturing said broken score lines and folding said cover along said transverse score line.

* * * * *